United States Patent [19]

Rilling

[11] 4,322,120

[45] Mar. 30, 1982

[54] PLUG-IN CONNECTOR WITH IMPROVED SPRING CONTACT

[76] Inventor: Hans Rilling, Schoenbrunner Str. 22, 8300 Landshut, Fed. Rep. of Germany

[21] Appl. No.: 151,265

[22] Filed: May 19, 1980

[51] Int. Cl.[3] ..... H01R 25/00

[52] U.S. Cl. ..... 339/47 R; 339/49 R; 339/198 G

[58] Field of Search ..... 339/47 R, 49 R, 198 G, 339/198 P, 198 S

[56] References Cited

FOREIGN PATENT DOCUMENTS 1954765 10/1971 Fed. Rep. of Germany .... 339/47 R
979514 1/1965 United Kingdom ..... 339/47 R

OTHER PUBLICATIONS

German DIN 41612, 41613.
Lear Siegler, Inc. 1976/77 Gold Book Advertisement for "Solderless Bus Bar for Common Connections".

*Primary Examiner*—Joseph H. McGlynn
*Assistant Examiner*—Frank H. McKenzie, Jr.
*Attorney, Agent, or Firm*—Hill, Van Santen, Steadman, Chiara & Simpson

[57] ABSTRACT

A plug-in connector having a spring contact strip for receiving and retaining at least one circuit board terminal has an additional spring contact disposed substantially perpendicular to the contact receiving the circuit board which permits side-by-side arrangement and retention of individual plug-in assemblies to construct a plug-in system of selected dimensions and further permits automatic electrical connection of selected circuit board receiving contacts so that manual wiring of the back panel is substantially minimized or eliminated.

7 Claims, 3 Drawing Figures

PLUG-IN CONNECTOR WITH IMPROVED SPRING CONTACT

BACKGROUND OF THE INVENTION

1. Field of the Invention

The present invention relates to plug-in connectors for connecting printed circuit boards to external circuitry, and in particular to an improved spring contact for such connectors which permits assembly of connector systems of selected length and minimizes or eliminates manual back panel wiring.

2. Description of the Prior Art

Plug-in connectors for releasably receiving an edge of a circuit board having printed terminal elements thereon are well known in the art. Such connectors generally consist of a plastic housing containing a plurality of spring contact strips which individually receive a circuit board terminal therebetween and retain same in place by means of spring tension. Such a plug-in connector is known, for example, from German AS No. 2,300,485 as well as "The Universal Plug-in Connector Family for Printed Circuit Boards According to DIN 41 612", Verlag Market and Technik, Dirk Hesse, 1979 and DIN 41 613.

Such conventional plug-in connectors utilize the spring contact as a bridge between the printed circuit and a wiring field which is connected to pins extending from the rear of the connector at a back panel in a number of rows. Connection can be made to the back panel pins in any manner known to those skilled in wire connection technology such as, for example, wire wrap, clamping, crimping, and soldering. Regardless of the wire connection technique employed, however, connection of the individual pins to the wiring field involves a substantial outlay in time inasmuch as such connection must generally be undertaken manually on a pin-to-pin basis.

Moreover, once connected, the conventional pin structure does not easily allow for modification of or addition to the wire connections should changes be made on the circuit board with which the connector is to be utilized. This disadvantage is particularly acute when subassembly circuit boards are subsequently augmented by additional plug-in units also carried on printed circuit boards.

SUMMARY OF THE INVENTION

It is an object of the present invention to provide a plug-in connector which minimizes or eliminates the necessity for individual pin connection to an external wiring field.

It is a further object of the present invention to provide a plug-in connector which can be easily mechanically and electrically mated with other connectors to form a connector system of selected dimensions and having a selected electrically conducting path or series of paths.

The above objects are inventively achieved in a plug-in connector having a second set of spring contacts carried on a spring contact strip disposed substantially perpendicular to the contacts receiving the printed circuit board. The second set of contacts is formed on the same electrically conductive strip which carries the circuit board receiving contacts as well as the terminal pin extending from the back panel of the connector associated with a particular set of contacts.

The improved spring contact also has a lateral pin extending perpendicularly with respect to the circuit board receiving contacts opposite to the second set of spring contacts. The lateral pin is receivable in the second set of spring contacts of an adjacent plug-in connector thereby electrically connecting the contacts of adjacent connectors without the necessity of manually wiring the back panel pins thereof together. A boss surrounding the lateral pin is integrally formed on a side of the connector housing which is received and retained in a correspondingly shaped receptacle in the side of an adjacent connector for additional mechanical support. If it is not desired to electrically connect adjacent contacts, the lateral pin can be severed before the connectors are put in place next to each other.

By mechanically and electrically joining plug-in connectors in accordance with the principles of the present invention, several advantages over conventional plug-in connectors are realized. Costly and time consuming manual back panel wiring connections hitherto necessary can be minimized to a significant extent and completely eliminated in certain special cases because of the direct plug contact which results from the lateral connector pins. Thus, modular systems of electronic devices such as, for example, data processing systems and electronic organs, which make extensive use of data bus lines can be constructed by simply joining an appropriate number of the inventive plug-in connectors. Moreover, when such devices are supplemented by the addition of further plug-in circuitry, additional inventive plug-in connectors can simply be inserted into the modular system without the necessity of rewiring the existing system.

By severing appropriate lateral pins where no electrical connection is desired between adjacent connectors, the combination possibilities are extremely varied. Severing of the lateral pins can be undertaken in combination with limited manual wiring which increases the circuit combinations to an even greater extent. Another possible application is the use of a connector system consisting entirely of the inventive laterally connected spring contact strips in combination with a conventional plug-in connector which has already been manually wired.

If a circuit board which previously required adjacent connectors to be in electrical connection is subsequently altered so that such electrical connection is no longer desired, the appropriate connector can be simply removed and a new connector substituted therefor which effects the desired electrical connection.

Although the inventive spring contact strips and connectors for direct or indirect patching of printed circuit boards can be compactly and interchangeably arranged in the same manner as known plug-in connector systems corresponding to the earlier cited known structures, the inventive concept herein can be utilized with circuit boards having any dimensions. It is also possible to embody the inventive concept disclosed herein in plug-in connector configurations having more than the two-row configuration discussed below, such as three or four row configurations. As stated in the above references, it has become a standard in the industry to utilize a minimum interval of 10.16 mm between printed circuit terminal strips, and such a standardized interval can easily be accommodated by the inventive connector.

In the so called two-row embodiment, the lateral pin connector elements can be imcorporated in one plane in the base of a single spring contact strip and preferably in such a manner that the pins are mutually offset by 180° at each contact spring. In the three-row embodiment, the third lateral connector pins are arranged in two planes. In each instance, chambers for the acceptance of a lateral pin connector are reserved for that purpose in the base of each spring contact strip.

Each of the spring contact strips embodying the lateral connector pin may be advantageously stamped from a single metal part together with the spring contacts also carried on the strip. Under certain conditions, the back panel connection pins may be joined together during manufacture.

DESCRIPTION OF THE PREFERRED EMBODIMENTS

Figure 1:
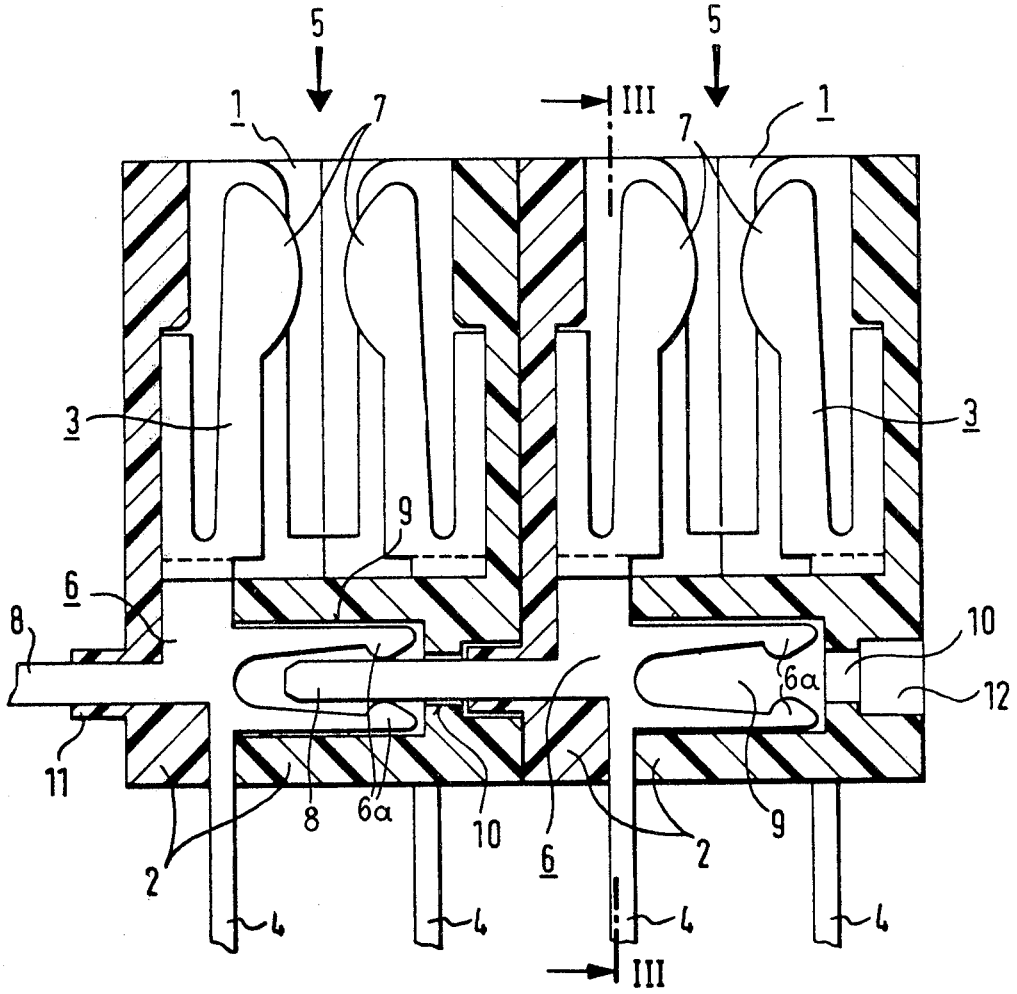
FIG. 1 is a sectional view of a pair of joined plug-in connectors constructed in accordance with the principles of the present invention.

A plug-in connector is shown in sectional view in FIG. 1 and is generally referenced at 1. The connector 1 has an insulating housing 2 comprised of plastic or other suitable material and a plurality of spring contact strips 3 retained therein at regular intervals along the length thereof. The contact strips 3 are comprised of electrically conductive material and each has a terminal pin 4 extending out of a back panel of the housing 2 for electrical connection to external circuitry. Wire connection to the terminal pin 4 may be made by any method known in the art. If the attachment method is wire wrap or clamping, for example, the pins 4 may be of rectangular cross section. Moreover, the pins 4 are disposed in the rear panel of the housing 2 at intervals corresponding to standardized modular dimensions for direct and/or indirect plug-in connection with printed circuit boards.

Each spring contact strip 3 has a tongue 7 thereon with opposing spring contact strips 3 receiving and retaining a terminal strip on a printed circuit board inserted in the direction of arrow 5 therebetween.

In accordance with the principles of the present invention, each spring contact strip 3 has a second set of spring elements shown at 6. The spring elements 6 each have a tongue **6*a* and are contained in a chamber 9 in a base of the housing 2**.

Each spring contact element 3 has further integrally formed thereon a lateral connector pin 8 extending substantially opposite to the second set of contacts 6. The contacts 6 and the lateral connector pin 8 lie substantially perpendicular to the remainder of the contact spring 3 and the connector pins 4.

Figure 2:
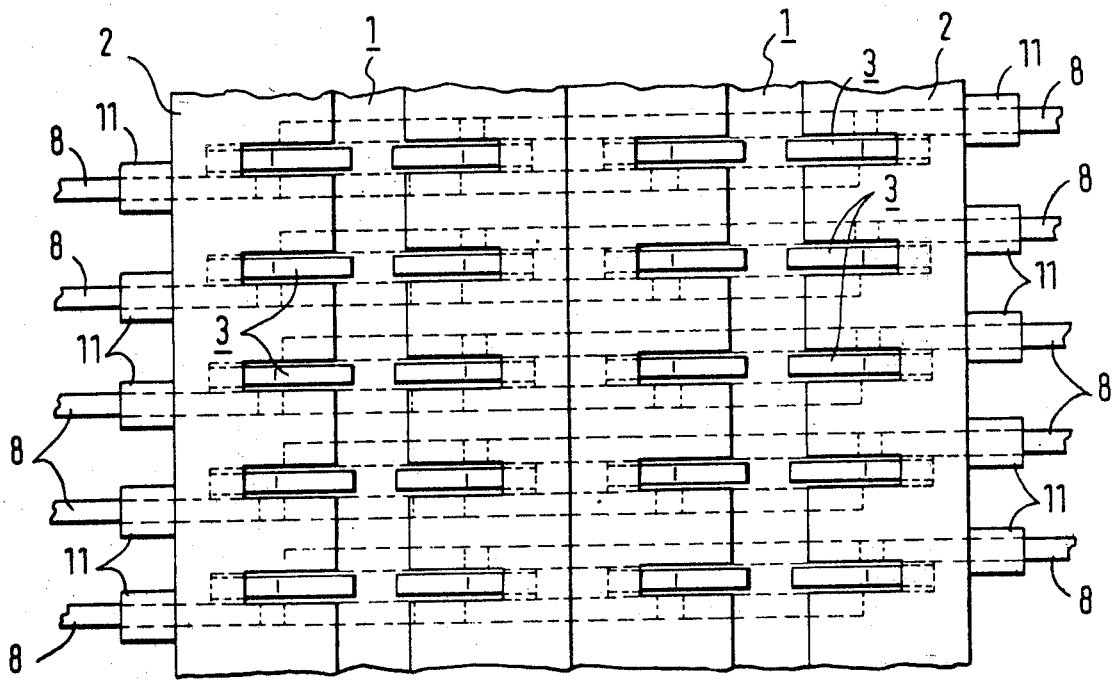
FIG. 2 is a plan elevational view of the connectors shown in FIG. 1 with the addition of numerous neighboring connectors of identical construction.
Figure 3:
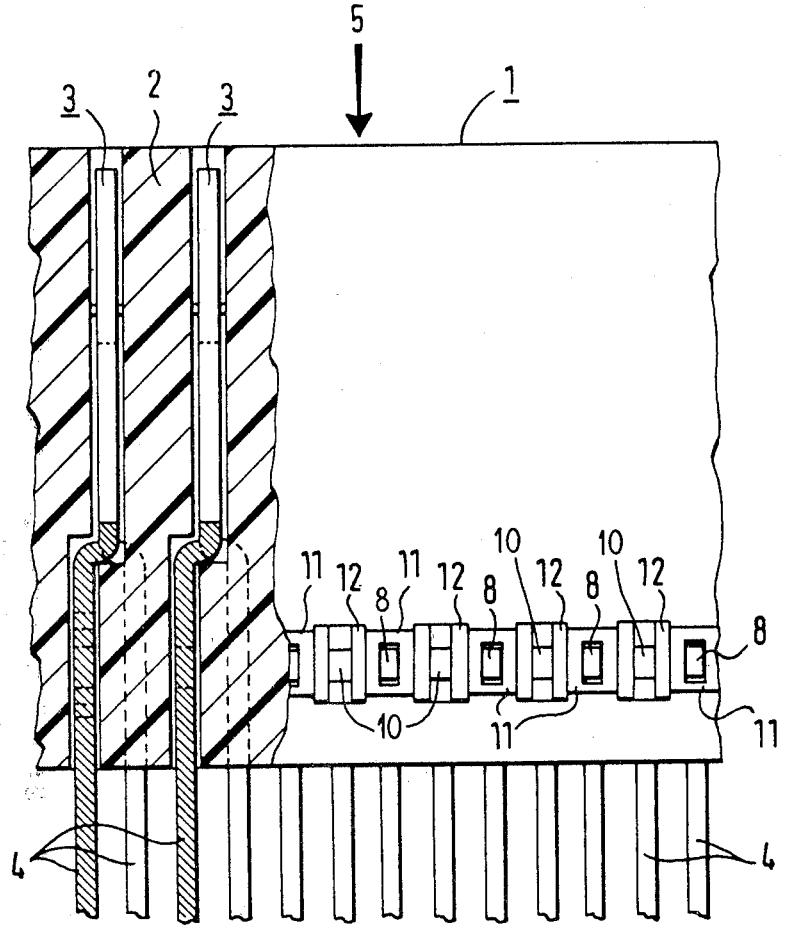
FIG. 3 is a side view of the connector of FIG. 1, partly in section along line III—III of FIG. 1.

As shown in FIGS. 2 and 3, in a two-row arrangement, the second set of contact springs 6 are arranged at each of the two legs leading to the rear panel pins 4 of a particular contact spring 3, being offset by 180° with respect to each other. In so doing, the inventive spring contact strips can be connected to one another in an interchangeable fashion. In applications wherein a continuous electrically connected bus is required, no additional manual external wiring is necessary and the individual plug-in connectors need only be inserted to a neighboring connector to effect the electrical connection. If it is known in advance that the connectors are to be used in such an application, the rear connector pins 4 may be eliminated altogether during manufacture.

Many comsumers, however, will be unable to ascertain in advance the precise manner in which the connectors will be utilized and moreover the precise electrical connections which will be necessary. The rear connector pins 4 will thus be retained for use as such consumers may find necessary and moreover continuous electrical contact through the lateral connector pins 8 can be interrupted at selected locations by severing specific pins 8 of the connector. In all cases, however, the multiplicity of contacting possibilities will be increased to a hitherto non-existent degree and at the same time the manual wiring required at the back panel of the connector 1 will be considerably minimized if not eliminated altogether. Furthermore, augmentations to a subassembly carrier circuit board are possible without the necessity of having to rewire all of the connector pins 4 by simply interchanging the various connectors with suitable electrically conducting or non-conducting lateral connections.

Each contact spring 3 can be manufactured from a single stamped part which includes the circuit board abutting tongues 7, the lateral connector 8, the lateral connector abutting tongues **6*a* and the rear connector pin 4**.

To further facilitate mechanical stability, a boss 11 is provided on a side of the housing 2 which surrounds and supports the lateral connector pin 8 and which is receivable in a correspondingly shaped and aligned receptacle 12 in the opposite side of an adjacent connector 1. This not only increases the mechanical stability of a combination of connectors 1, but moreover relieves some of the stress on the lateral connector pins 8. By such connection, the plug-in connectors 1 can be arranged in a block as shown in FIG. 2 with good stability. Stability can be further increased by providing snap-in tongues (not illustrated) for fastening to the frame of a subassembly carrier or by any other fastening means known in the art. The inventive concept disclosed herein may further be easily adapted to a three-row arrangement of connectors 1.

Although other modifications may be suggested by those skilled in the art, it is the intention of the inventor to embody within the patent warranted hereon all changes and modifications as reasonably and properly come within the scope of his contribution to the art.

I claim as my invention:

1. A plug-in connector for use with printed circuit boards comprising:

a housing consisting of insulating material;

a plurality of first contact springs opposed in said housing for receiving and making electrical connection with a circuit board, and each having a rear connector pin disposed at a rear panel of said housing for electrical connection to external circuitry;

a plurality of pairs of second contact springs respectively carried on at least some of said first contact springs and disposed generally perpendicular thereto; and a plurality of lateral connector pins respectively disposed opposite each of said second contact spring pairs, said lateral connector pins extending out of a side of said housing, said housing having a plurality of apertures for receiving lateral connector pins of an adjacent plug-in connector for insertion between and electrical connection with said second contact spring pairs.

2. The connector of claim 1 wherein each first contact spring carries a pair of said second contact springs, with pairs of second contact springs carried by opposing first contact springs being disposed at a 180° offset with respect to each other.

3. The connector of claim 1 wherein said housing has a plurality of chambers disposed at a rear portion thereof, and wherein said second contact spring pairs are respectively disposed in said chambers.

4. The connector of claim 1 wherein each of said lateral connector pins is surrounded by a boss upon exiting from said side of said housing, and wherein each of said apertures is correspondingly shaped for receiving said boss for mechanically joining and aligning adjacent connectors.

5. The connector of claim 1 wherein said first contact springs, said pairs of second contact springs, said rear connector pins and said lateral connector pins are all carried on a single stamped electrically conductive metal element.

6. The connector of claim 1 wherein said rear connector pins and said lateral connector pins are individually selectively severable from said first contact springs.

7. In a plug-in connector for use with printed circuit boards having an insulating housing the improvement of a stamped electrically conductive metal element for said connector comprising:

a first contact spring engageable with a circuit board and acting in cooperation with an opposed identical first contact spring carried on another metal element in said housing for receiving and making electrical connection with said circuit board;

a pair of lateral second contact springs disposed substantially perpendicularly to said first contact spring in said housing;

a lateral connector pin disposed opposite said pair of second contact springs and extending out of a side of said housing, said lateral connector pin being receivable between a pair of said second contact springs in an adjacent plug-in connector; and a rear connector pin extending substantially perpendicular to said pair of second contact springs and said lateral connector pin a distance out of a rear panel of said housing.

* * * * *